United States Patent [19]

Stobart

[11] Patent Number: 4,947,922

[45] Date of Patent: Aug. 14, 1990

[54] TENSIONING STRETCHED-CANVAS FRAME AND METHOD FOR USE

[76] Inventor: John Stobart, Townhouse #23, Union Wharf, Boston, Mass. 02109

[21] Appl. No.: 307,789

[22] Filed: Feb. 7, 1989

[51] Int. Cl.[5] ..... D06C 3/08

[52] U.S. Cl. ..... 160/374.1; 160/381; 38/102.5

[58] Field of Search ..... 160/374.1, 374, 373, 160/372, 376, 378, 381, 405; 38/102.5, 102.4, 102.6, 102.7, 102.8, 102.9, 102.91

[56] References Cited

U.S. PATENT DOCUMENTS

| | | | |
|---|---|---|---|
| 371,933 | 10/1887 | Gray | 160/374.1 |
| 371,934 | 10/1887 | Gray | 160/374.1 |
| 1,128,362 | 2/1915 | Rawbon | 160/374.1 |
| 2,149,985 | 3/1939 | Tepper | 160/374.1 |
| 3,238,996 | 3/1966 | Munn | 160/374.1 |
| 4,829,685 | 5/1989 | Persson et al. | 160/381 X |

OTHER PUBLICATIONS

Goldline—Flier—"Constant Tension Stretched Canvas".

"Framer's Workbook", *Decor* (1986), pp. 242, 244, 246.

"Portable Supports", *Painting Surfaces,* pp. 128–137.

*Primary Examiner*—David M. Purol

*Attorney, Agent, or Firm*—Stetina and Brunda

[57] ABSTRACT

A tensioning stretched-canvas frame and method of use is disclosed characterized by the end portion of adjacent frame members having complementary cavities formed therein which receive a spring insert adapted to persistently force the frame members apart against the retention of canvas stretched taut thereover. The spring insert resists both rotation within the cavities and bending in the plane of the frame, accordingly making the assembled frame resistent to twisting between the frame members, distortion of the frame area, and warping of the frame's plane. A disposable bridging member may be temporarily used to maintain the frame members in abutting contact against the spring forces during initial stretching of the canvas.

6 Claims, 4 Drawing Sheets

TWISTING
22
10
40
20
20
ANGULAR BENDING
WARPAGE
ANGULAR
BENDING
DISTORTION
22
30
30
20
40
22
44
40
42
20
26
22
24
32
30
22
26
24
20

52
4
50
4
52
20
20

52
27
20
28
50
29

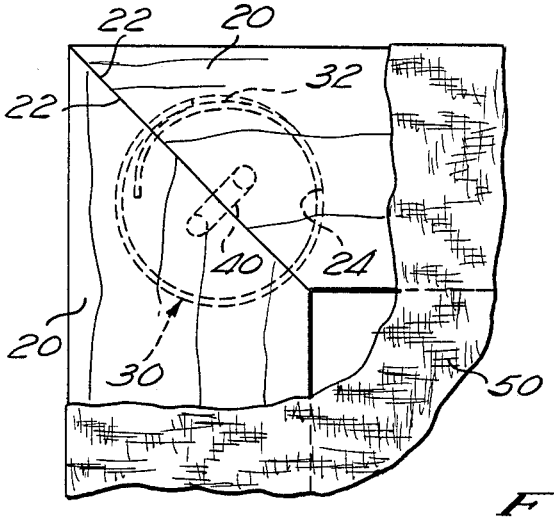
Fig. 5
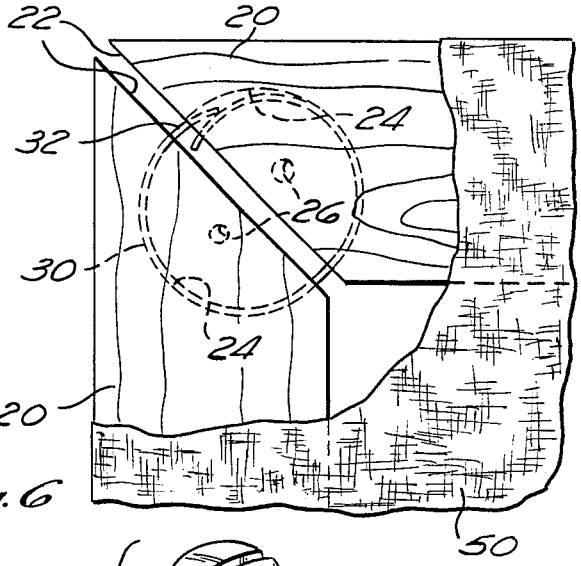
Fig. 6
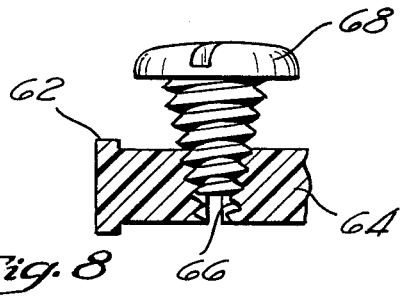
Fig. 8
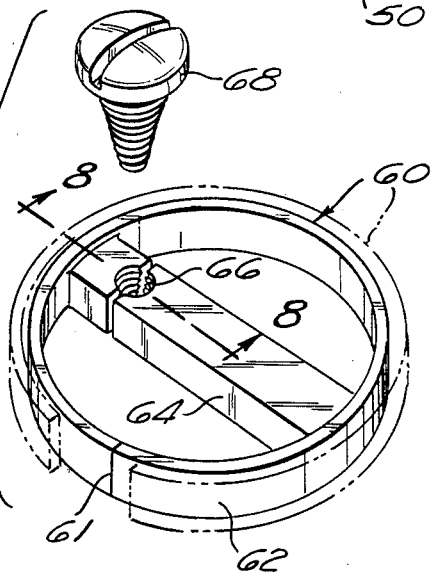
Fig. 7
Fig. 9
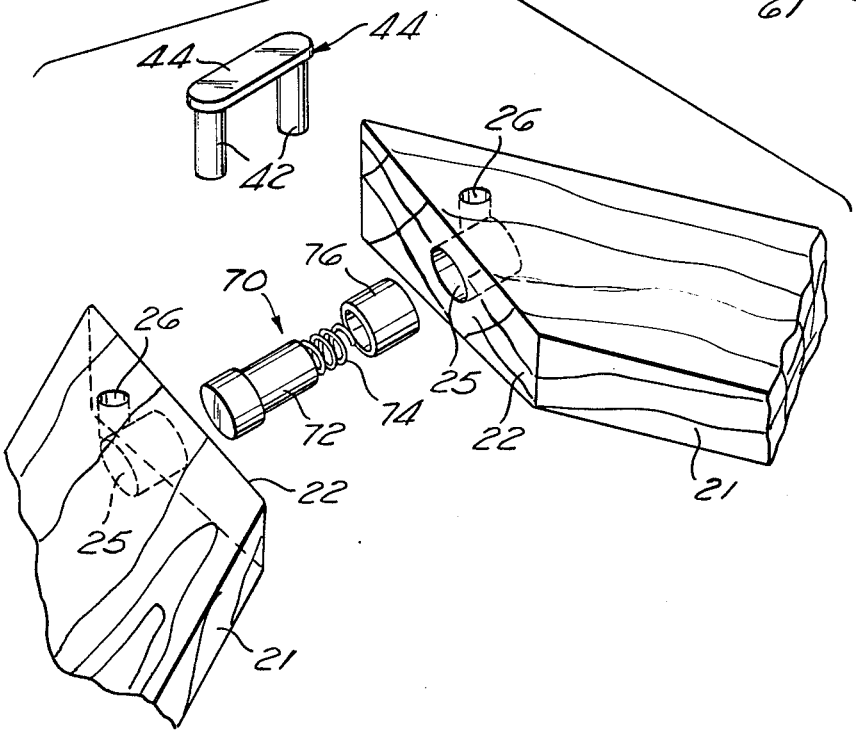

TENSIONING STRETCHED-CANVAS FRAME AND METHOD FOR USE

BACKGROUND OF THE INVENTION

1. Field of the Invention

The present invention concerns frames which mount an artist's canvas and more particularly frames which tension such canvas to eliminate any distortion or wrinkle lines developing on the surface of the canvas.

2. Description of the Relevant Art

An artist's canvas is held stretched taut upon a stretcher bar frame. The requirments of such a frame are that it should be optimally rigid against torsion and twisting, dimensionally stable during temperature or humidity changes, lightweight, and inexpensively constructed of readily available materials. Typically the frame is made of wood with mitered corners which may exhibit duck tail or other types of interlocking corner joints.

Over prolonged time periods distortion of a stretched-canvas frame is induced by longitudinal and lateral stresses arising from the canvas or from the environment. These stresses can cause deviation from the desired angle between frame members (normally a right angle) and/or a twisting or warping of the frame in its established plane. Such warpage or twisting of the frame typically causes stress to be developed in the canvas which, after prolonged duration, results in wrinkles being generated in the canvas. In an attempt to remedy such wrinkles, it has long been known to manually drive wooden wedges between adjacent ends of the frame members at the mitered corners of the frame, which cause a selective spreading of the frame members to re-stretch the canvas thereon. Such wooden wedges, however, typically weaken the corner joint integrity and often result in further frame warpage, thereby perpetuating the problem. In addition, the manual driving of the wedges into the corners of the frame often causes inadvertant cutting or tearing of the canvas due to abrasion of the wedge upon the rear surface of the canvas. Such inadvertant tearing, of course, results in permanent non-recoverable damage to the artist's rendition on the canvas. In view of recognition of this problem, certain framing solutions involving the long-term tensioning of canvas stretched upon a frame have been sought. Particularly, certain frames which constantly tension the canvas stretched upon such frames have been developed in the prior art.

One prior art frame of this type is the "GOLDLINE" constant tension, stretched-canvas frame available from H. W. Peel & Co., Ltd., Norwester House, Fairway Estate, Fairway Drive, Greenford, Middlesex, UB6 8PW, United Kingdom. This frame uses wood peripheral frame members which are mitered to approximately 45 degrees at their corners. An elongate metal spring clip is positioned between adjacent frame members at the junction of their mitered corners. This spring clip tends to force the adjacent frame members apart from each other. The frame members are not directly or rigidly affixed to each other. Rather, in order to hold each pair of adjacent frame members together in their desired spatial relationship defining a frame, a plastic corner piece is used at each corner joint. The plastic corner pieces slidably engage adjacent wooden frame members and lie over the top of the centrally positioned spring clip. The plastic corner pieces attempt to hold the wooden frame members, which are being forceably spread apart by the spring force generated in the intervening spring clip, in positional alignment even though the frame members are not in direct contact with one another. In maintaining this positional alignment, the plastic corner pieces attempt to suppress the torsional, longitudinal, and vertical movements which might otherwise result in a distortion of the frame. The plastic corner pieces further attempt to prevent twisting of adjacent frame members relative to one another, and to thereby prevent any resultant distortion of the plane of the canvas established by such frame. As will be discussed after further consideration of the construction of this prior art constantly tensioning, stretched-canvas frame, these attempts are not completely successful.

In order to assemble the "GOLDLINE" constant tension, stretched-canvas frame, the canvas is stretched over, and tacked to, the sides of the peripheral frame members while the frame members are held in alignment by the plastic corner pieces. The metal spring clips are then positioned between the mitered corners of adjacent frame members, thereby spreading the frame members apart and tensioning the canvas. In order that even further additional tensioning forces may be applied, it is also known in this prior art frame to position a central cross member consisting of two perpendicular arms within the rear interior region of the frame. Each arm of the cross member spans between an opposed pair of frame members. Each of four ends of the two cross member arms do not directly abut the frame member adjacent its end, but rather contact the frame member through additional intervening spring clips. Since the wooden pieces of the peripheral frame members and of the cross member are not directly connected, plastic guide pieces are used to maintain required alignments. The additional cross member, plastic corner pieces, and the plastic guide pieces undersirably add considerable weight and cost to the frame.

This particular "GOLDLINE" prior art stretcher frame is utilized to continuously present tensioning forces to the canvas which is stretched taut upon it. However, in order to obtain this tensioning, and the required "full-floating" relationship between all frame members, this prior art tensioning frame incurs a great penalty in the establishment and maintanence of a precision alignment between and among the frame members The plastic corner pieces must slidably engage the frame members over a large surface area, on the order of several square inches, in order to obtain an adequate grasp on such frame members for the purpose of establishing and maintaining their relative alignment. However, both the frame pieces and the plastic corner pieces are poorly adaptable to precision construction. Furthermore, the dimensions of the wooden frame members vary with temperature, humidity, and age relative to the retaining plastic corner pieces. These prior art corner plastic pieces, which slidably engage the frame members in order to guide them into alignment, have therefore proven to be generally inadequate for this task. Particularly, the "GOLDLINE" prior art stretcher frame does not exhibit an alignment between frame members which is as equivalently rigid, precise, or permanent to the alignment routinely attained by prior art fixed, non-tensioning frames with rigid corner joints.

Consequently, it is desired to produce a frame for the tensioning of stretched canvas which precisely establishes and permanently maintains a highly accurate angular positional relationship between frame members.

From the perspective of the canvas stretched taut upon such a frame, the frame will expand in size as necessary to maintain a constant tension upon the canvas while resisting warpage or bow. Further, the shape of the frame will not change in symmetry from the desired polygonal shape in which the frame was initially constructed. For example, when such a frame is initially constructed as a rectangle then it will not, over time, assume the shape of a parallelogram wherein the corners of the frame are not at right angles. Neither will the frame members twist relative to one another. Finally, the frame should be of comparable wight and cost to conventional, non-tensioning frames.

There exists still another, more subtle, problem with prior art tensioning frames for canvas, including, with the "GOLDLINE", constant tensioning, stretch-canvas frame. Mainly, the prior art tension-providing spring clips or other steel spring members are often difficult to use safely in their operative position which is closely proximate to the artist's canvas. Any mispositioning, misinsertion, and/or misadjustment of the prior art spring clips may force them into contact with the canvas mounted upon the frame, and may even cause them to inadvertently tear the canvas in a manner analogous to the prior art use of wooden wedges.

Consequently, it is additionally desired that a constant-tensioning, stretched-canvas frame should be capable of being readily assembled, dissembled, and/or adjusted without hazard to the canvas mounted there upon. It is further desired that any permissible movement of the frame pieces over long periods of time should never hazard the canvas.

As a final, subsidiary, element of frame design it is known to chamfer the outer perimeter edges of peripheral frame members, which are nominally made of wood, in order to increase the surface area of contact of such frame members with the canvas stretched thereupon. However, the inner peripheral edges, and the inner peripheral surface adjacent to these edges, are normally at the same close spacing relative to the plane of the canvas as are the exterior circumferential edges and adjacent exterior peripheral surface of the same frame members. Consequently, if a canvas suffers inward pressure—such as may routinely be generated by thermal stress through the period of many years, the canvas is apt to pick up indentations, ultimately resulting in creases or wear areas at these pressure points or pressure lines whereat it contacts the inner periphery of the frame members. A canvas which suffers these indentations visually appears to assume a pressure imprint upon its front surface outlining its rearwardly-disposed frame members. This phenomenon of "frame marks", usually seen predominantly in older canvas, is highly undesirable. Consequently, in addition to all other requirements that the canvas should be securely, safely, and continuously tensioned and stretched in a flat plane, it is still further desired that the canvas should not be contacted by the frame during the long course of being maintained thereon at any location other than its periphery.

Although prior art approaches to the tensioning of canvas stretched taut upon a frame may be perceived to exist, in accordance with the preceding discussion it will be understood that the detailed requirements of optimally perfoming this task might be highly sophisticated. This is indeed the case, especially when it is considered that all applied solutions must perform satisfactorily over a period of time which often is conservatively measured in centuries.

SUMMARY OF THE INVENTION

The present invention is embodied in a tensioning stretched-canvas frame apparatus, and the method of mounting canvas to such a frame. The frame, in accordance with the present invention, includes plural, and nominally four, substantially linear peripheral frame members arranged so as outline or frame an area, nominally the area of a rectangle. Each end of each frame member has an end portion which is preferably mitered to abut the corresponding end portion of an adjacent member in a complementary fashion.

In accordance with the present invention the mitered end portion of each peripheral frame member includes a cavity. This cavity abuts and is aligned with a corresponding cavity in the mitered end portion of an adjacent frame member. Within the aligned cavities and between adjacent frame members is disposed a biasing member of various types. When a canvas is stretched taut upon the frame, bringing the adjacent peripheral frame members into abutting contact, then the biasing member is compressed within the adjacent cavities of the adjacent peripheral frame members. The biasing member, residing within and between these frame members, exerts a continuous biasing force. This biasing force tends to force the adjacent frame members apart from one another, in a direction normal to the mitered ends of the frame members, thereby tensioning the canvas stretched taut over the frame with a constant, spring-generated, force.

Moreover, in accordance with the present invention the biasing member, preferably (i) resists rotation within each abutting cavity within which it is disposed and (ii) is itself rigid against both torsional and bending forces. This combination—that the biasing member does not rotate within either cavity while being itself inflexibile to certain forces—insures that adjacent peripheral frame members resist both rotation and angular bending relative to one another. The resistance to bending is both within the plane of the frame, meaning resistance to deviation from the nominal 90-degree right angle at which the frame members are positioned, and outside the plane of the frame, meaning that the frame will not warp or bow. As such, in contradistinction to prior art canvas tensioning systems such as the "GOLDLINE" system; the biasing force as well as the structural integrity of the frame is facilitated solely by the biasing member itself and not by any intervening counter support member or crossbar member.

In one preferred embodiment of the present invention, the biasing member comprises a substantially circular band of spring metal. In appearance the spring band is similar to a flat wound torsional spring. However, the spring band is not used for resisting or inducing torque, but is used rather for inducing a radial expansion force. The band is severed at a point along its circumference, thereby allowing it to be forcibly radially compressed in order to assume a reduced diameter. The compressed band fits into the semicircular cavities formed in the mitered ends of adjacent peripheral frame members. The band is sized to have an axial length, i.e. thickness, as to fit tightly into such cavities. When compressed in position within the cavities, the circular band exerts a spreading spring force against the cavities and against the associated peripheral frame members, between which it is maintained.

Furthermore, the band will not rotate within the cavities, neither will it bend or flex in any direction except radially outward along the flat plane of the composite frame. It thus maintains the adjacent frame members in fixed permanent alignment while tending to force the members apart from one another, thereby tensioning the canvas stretched taut upon the frame.

In another embodiment of the present invention, the biasing member comprises a cylindrical split ring having an integrally-formed bridge or chord extending through its interior. A split aperture is formed in the chord, which aperture includes a threaded tapered axial cross-sectional configuration. The aperture is sized to threadingly receive a tapered screw, which may be variably insertable into the aperture of the chord in order to force apart the ends of the chord adjacent the aperture and thereby selectively enlarge the circumference of the split ring. By such a forced spreading, the biasing force exerted by the split ring is variably adjustable. Moreover, such adjustment is without hazard to the integrity of the frame or of a canvas mounted thereupon.

In another embodiment of the present invention, the biasing member comprises a spring-loaded telescoping member which is inserted within complimentary-shaped cavities, nominally cylindrical bores, formed within the mitered ends of each peripheral frame member. This spring-loaded telescoping member is simple, inexpensive, and strong while being effective to prevent rotation between the frame members.

In another embodiment of the present invention, the biasing member comprises a biasing wheel and cam element having camming surfaces which are inserted within a complimentary-shaped central bore, and counter bore, formed within the mitered ends of the peripheral frame member. The frame members are adjusted to their desired expanded configuration simply by manually rotating the biasing wheel, causing the camming portion and camming faces to cam adjacent frame members apart. A rigid disk is additionally provided in this embodiment to prevent the twisting of the frame members relative to one another.

An assembly method, in accordance with the present invention, is preferably accomplished by use of a disposable bridging clamp which temporarily bridges over and locks together adjacent frame members. The frame members, which are mitered in their end portions and which have the biasing members disposed in their end cavities, are brought into an abutting contact, thereby compressing the biasing member therebetween. The members are then temporarily restrained in this abutting contact by a U-shaped bridging clamp which is inserted into a complementary bores formed within each frame member, thereby temporarily securing the adjacent frame member in abutting contact. A canvas is then stretched taut over the frame and affixed thereto Finally, the U-shaped temporary bridging clamps are removed, allowing the frame members to spread apart in response to the biasing force and against the restraint of the canvas stretched over such frame members, thereby tensioning the canvas.

BRIEF DESCRIPTION OF THE DRAWINGS

These, as well as other features, aspects, and advantages of the present invention, will become more apparent upon reference to drawings wherein:

FIG. 5 is a cut-away view showing a corner of the first embodiment frame in accordance with the present invention temporarily compressed for assembly;

FIG. 6 is a cut-away view showing a corner of the first embodiment frame in accordance with the present invention in its operative position;

FIG. 7 is a perspective view showing a variably expanded and variably tensionable split ring biasing member of a second embodiment frame in accordance with the present invention;

FIG. 8 is a partial cross-sectional view taken along lines 8—8 of FIG. 7 showing the tapered adjustment screw and chord strut used in the cylindrical split ring biasing member of the second embodiment frame of the present invention;

FIG. 9 a detailed perspective exploded view, similar to FIG. 2, of a corner of a third embodiment frame in accordance with the present invention;

DESCRIPTION OF THE PREFERRED EMBODIMENT

The present invention is an improvement to tensioning frames, particularly for canvas, and to the method of mounting canvas upon such frames. By way of overview, a frame is made of plural, and nominally four, nominally linear frame members. These members are disposed to frame an area, nominally a rectangle but also possibly a triangle, circle, or other geometric figure. Each frame member has end portions which are preferably mitered to abut corresponding end portions of adjacent members in a complementary fashion. A canvas is stretched taut over all the members of the frame, and thereafter consititutes the framed area. The tensioning canvas-stretching frame of the present invention employs biasing means between adjacent frame members at their abutting ends. The biasing means exert a persistent biasing force which tends to force the adjacent frame members apart from one another against the restraining force of the canvas stretched tautly over and affixed to the members, thereby tensioning the canvas upon the frame.

Figures 1, 2, 3, 4:
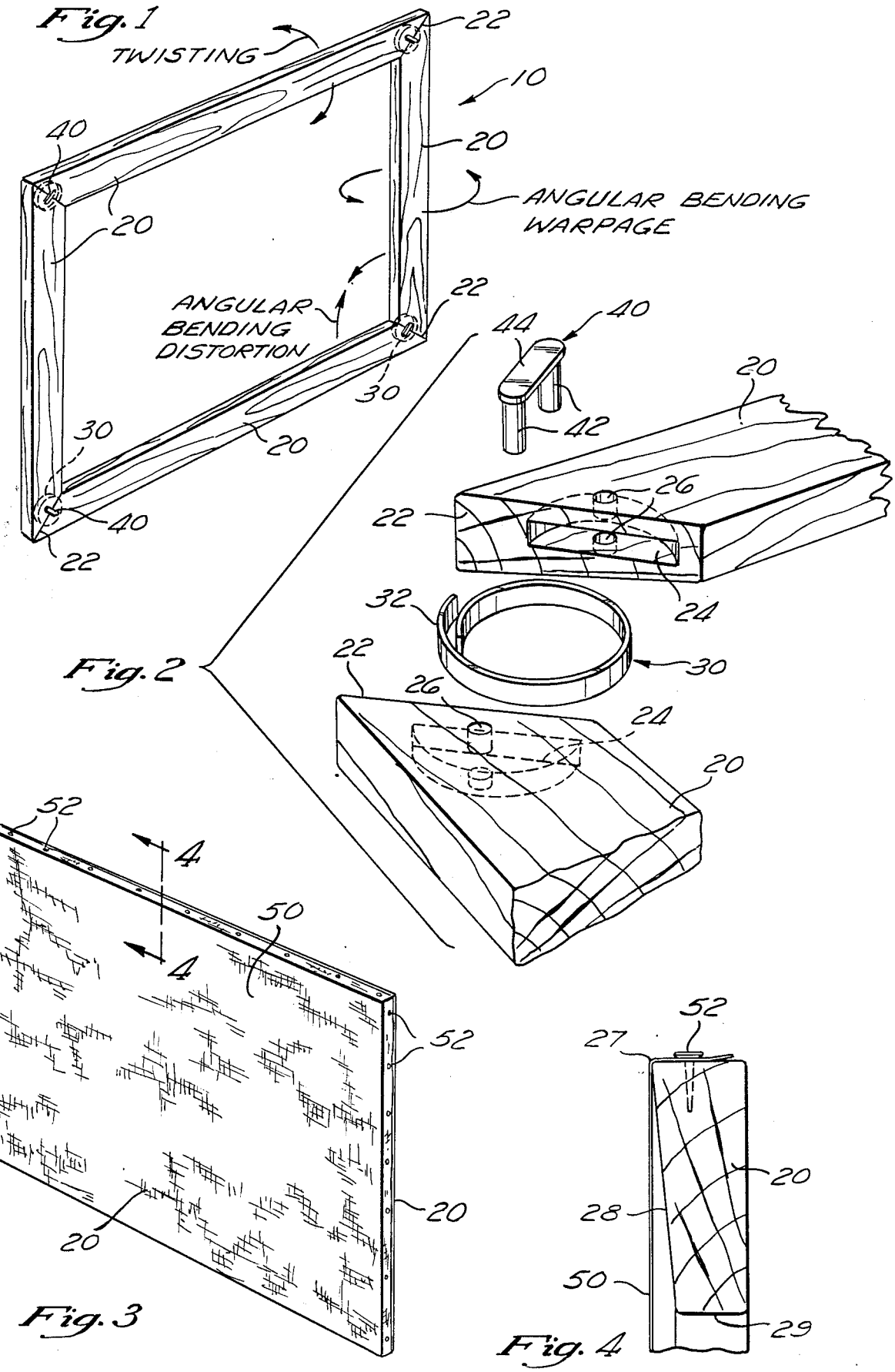
FIG. 1 is a pictorial view showing a first embodiment frame in accordance with the present invention.
FIG. 2 is a detailed perspective exploded view of a first embodiment, frame corner in accordance with the present invention.
FIG. 3 is a perspective view of a canvas mounted upon any of the frame embodiments in accordance with the present invention.
FIG. 4 is a cross-sectional view taken along lines 4—4 of FIG. 3 showing the exterior circumferential frame bevel edge continuing in an incline toward an interior circumferential frame edge, which interior edge is displaced from the plane of the canvas which is stretched upon the frame.

A first embodiment of the present invention may be generally observed in FIGS. 1 and 2. These Figures show a frame 10, particularly a rectangular frame, constructed in accordance with the present invention. The frame 10 is made of plural elongate frame members of stretcher bars 20 which exhibit complementary mitered ends 22; nominally surfaces which are mitered at 45 degrees relative to the axis of the member as illustrated Each of the frame members 20 has and defines within its mitered ends 22 a cavity 24. The cavities 24 of two adjacent such frame members 20 abut in a complementary aligned registery. In the first embodiment, the cavity 24 is formed in a semicircular configuration in the shape of a half disk. Two such abutting cavities thereby form a disk-shaped cavity or void into which biasing member 30 is received. A particular first embodiment of the biasing member 30, which embodiment is complementary with the semicircular cavities 24, is shown in FIG. 2 and comprises a spring metal band 32. The spring metal band 32 has a normal, relaxed diameter, shown in FIG. 2, which is larger than the diameter of the cavities 24 within frame member 20 and is compressible radially to a smaller diameter, shown in FIG. 5, so as to be received within the cavities 24 formed on adjacent frame members. Consequently, when the frame members 20 are abutted along their mitered ends 22 with the circular spring band 32 disposed therebetween, then such band is significantly compressed. This compression is best illustrated in FIG. 5 as spring band 32 (compressed).

Each of the frame members 20 includes an aperture 26, nominally in the shape of a bore, proximate its mitered ends 22, preferably positioned inboard and along an axis which is substantially parallel to its mitered end 22. In FIG. 2 the aperture 26 is illustrated to be formed within the area of the cavity 24, but it needs not be so limited. A bridging member 40, comprising a top plate 44 and a pair of cylindrical leg or peg portions 42 extending perpendicularly therefrom, is provided to cooperate with the apertures 26. The bridging member 40 is sized so that it will span from the aperture 26 of one frame member 20 to the aperture 26 of an adjacent frame member 20 when both such frame members are tightly abutted along their mitered ends 22, with the cylindrical peg portions 42 extending within the apertures 26. The bridging member 40 is so illustrated in this spanning position in FIG. 5. The bridging member 40 is positioned on the rear of the frame 10, opposite to canvas 50, and as such, may be easily inserted therein without inadvertant contact with the canvas. Further, the axial length of the peg portions 42 is sized less than the depth of framing members 20 so as not to contact the canvas 50 upon the front surface of the frame 10 In this manner the canvas 50 is fully protected against inadvertant damaging contact.

The bridging members 40 are only temporarily maintained in their bridging position, shown in FIG. 5, to provide stability to the frame structure to permit the canvas 50 to be initially stretched taut over and affixed to frame members 20 by fasteners, nominally by the nails or tacks 52 shown in FIG. 3. After this initial manual stretching of the canvas, 50 upon and over the frame, the bridging members 40 are removed, wherein the spring band 32 will be unrestrained to expand within opposed cavities 24 and between the ends of adjacent frame members 20 from their initial compressed configuration, depicted in FIG. 5, to their subsequent expanded configuration shown in FIG. 6. In this expanded configuration, the spring bands 32 exert a continuous expansion force to the frame members in a direction normal to the mitered ends of the frame members. Due to the properties of high quality band springs, this force is substantially constant over the relatively small distances as the spring expands or contracts, and is substantially constant over prolonged time periods ranging to many years. Although many common band spring materials are suitable for implementing spring band 32, non-corroding metals such as stainless steels are preferred so that no corrosion products should be transferred to canvas 50 or frame members 20. In its expanded position the spring band 32 (expanded) forces, i.e. biases, the adjacent frame members 20 apart, and thereby constantly tensions the canvas 50.

It should be recognized that variants of spring band 32 are possible. The spring can be wound as a torsion spring from circular wire, or as a multi-turn flat spiral spring, which is commonly used in clocks. Planar springs of other than circular configuration are additionally possible and are contemplated herein.

An individual frame member 20 may be subject to rotation, or "twisting", at its point(s) of connection(s) to an adjacent frame member(s). This "twisting", while undesirably rippling the surface of canvas 50, does not appreciably alter the rectangular shape of the frame 10, nor does it warp the plane of such frame. Another possible motion undergone between frame members 20 within frame 10 is an "angular bending in the plane of the frame". This bending causes the angles between frame members 20 to change from their precise 90 degrees orientation, thereby causing the frame 10 to assume the shape of a parallelogram as opposed to a rectangle. This bending is called "distortion", meaning that the (nominally polygonal) shape of the frame and the shape of any representations upon the canvas affixed to the frame become distorted. Again, this "angular bending in the plane of the frame", although very detrimental to the surface of the canvas which was affixed when the frame members 20 were in their original angular orientation, does not significantly distort the plane of the frame. Finally, it is illustrated in FIG. 1 that "angular bending outside of frame plane", or "warping" occurs whenever any of the frame members 20 cease to lie within the same plane.

Considering the position of spring band 32 positioned tightly within complementary cavities 24 of frame members 20, as is shown in FIGS. 1, 2, 5, and 6, this tight positioning particularly aids in preventing "twisting", "angular bending outside of the frame plane", and "warping". Specifically, the spring band 32 will not rotate within the cavities 24 wherein it tightly fits. Neither will spring band 32 bend in the planes of the canvas 50 or of the frame 10, or in any plane which is coplanar with these planes. Resistance to "angular bending in the plane of the frame" is usually sufficiently accomplished by the mitered ends 22 when the canvas is originally affixed. After affixation, the canvas maintains the polygonal shape of the frame (However, an adaptation of the spring biasing means of the present invention which is also contributory to preventing "angular bending in the plane of the frame" will be shown in FIG. 9.)

A second preferred embodiment frame in accordance with the present invention employs a biasing member 60 which is illustrated in FIGS. 7 and 8. A cylindrical split ring 62 of spring metal, nominally flat spring steel, possesses a bridge or chord 64 extending through its interior. The split point 61 is positioned outside the points whereat bridge 64 connects to ring 62, and is nominally located at a point upon the ring corresponding to the midway point along bridge 64. A tapered screw 68 is threadingly received within a complementary tapered threaded hole 66 formed within bridge 64. The tapered screw 68 may be variably threaded into the hole 66 of tapered axial cross-sectional configuration in order to variably spread bridge 64 and ring 62, inducing a correspondingly variable spreading force against the frame members 20 (shown in FIGS. 1, 2, and 4–6) which are contacted by the split ring 62. The split ring 62 should be understood to produce spring forces in and of itself, the adjustment obtained by bridge 64 and tapered screw 68 serving merely to adjustably increase these spring forces.

A third preferred embodiment, in accordance with the present invention, is shown in FIG. 9. The biasing member comprises a spring-loaded telescoping member 70 which has a first end cap 72 and a second end cap 76 held in forced separation by spring 74. The end caps 72 and 76 of the telescoping member 70 fit into complementary cylindrical bores 25 formed within the frame members 21. More than one telescoping member 70 may be used between adjacent frame members 21. Indeed, it may be desirable to do so in order to better prevent twisting of the frame members relative to one another. Alternatively, one telescoping member 70 and one guide dowel (not shown) may be located between adjacent frame members. The telescoping member 70 is strong, inexpensive, durable, slides well in bores 25, and seals these bores against ingress of dirt and moisture. It leaves more material, nominally wood, in the mitered ends of frame members 21. A plurality of these spring-loaded dowel pins 70, located between adjacent frame members, may be used to establish all desired forces and torques with great rigor and precision. When a plurality of spring-loaded dowel pins 70 are employed, then they may exhibit some redundancy, and thus provide a fail-safe capability to the frame in accordance with the present invention.

Figure 10:
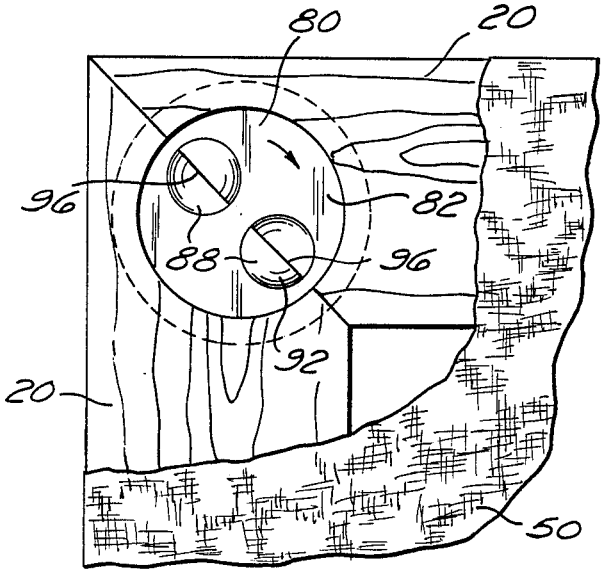
FIG. 10 is a cut-away view showing a corner of a fourth embodiment frame in the abutted, unbiased position.
Figure 11:
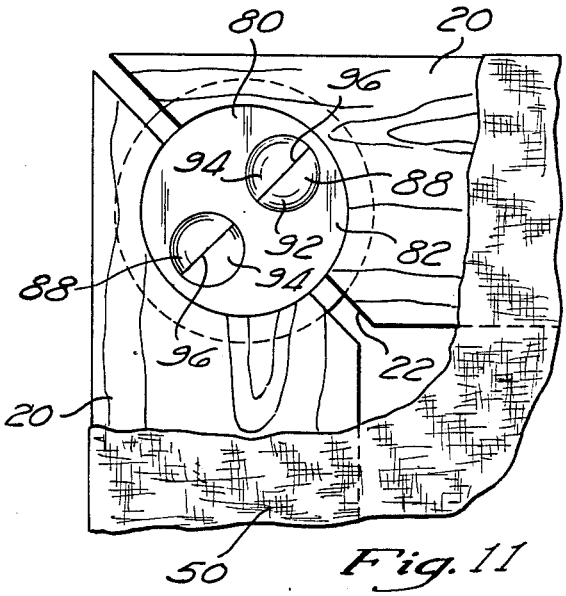
FIG. 11 is a cut-away view showing the corner of the fourth embodiment frame in accordance with the present invention in its operative, or biased position.

The fourth embodiment of the present invention is shown in FIGS. 10–17. As generally depicted in FIGS. 10 and 11, the biasing means of this fourth embodiment includes a biasing member 80, which when manually rotated clockwise, exerts a camming force to the frame members in a direction normal to the mitered ends thereof, causing them to move to an expanded configuration as shown in FIG. 11.

Figure 12:
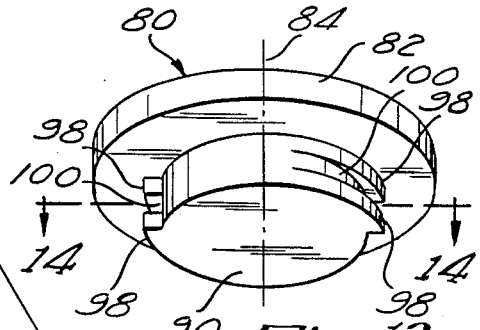
FIG. 12 a perspective view showing the biasing member of the fourth embodiment of the present invention.
Figure 13:
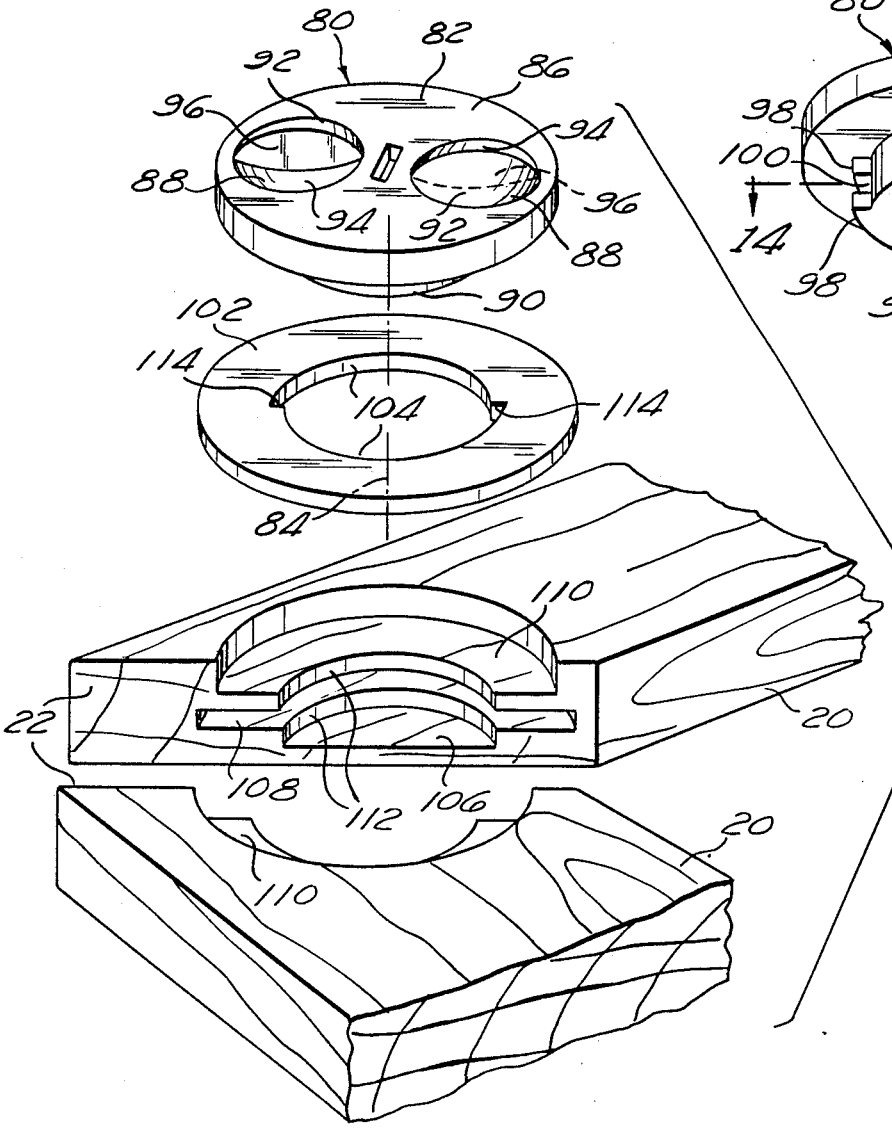
FIG. 13 is a detailed perspective exploded view, similar to FIGS. 2 and 9, of a corner of a fourth embodiment frame in accordance with the present invention.

As shown in greater detail in FIGS. 12 and 13, the biasing member 80 comprises a circular, disk-shaped biasing wheel 82, with a central axis of rotation 84 located at its center and normal to the surface forming its upper side 86. The biasing member 80 additionally includes a pair of finger hold portions 88 formed integral with the upper side 86, and a cam portion 90 formed integral and coaxial with the biasing wheel 82 on its opposite or under side.

Each of the two finger hold portions 88 is formed having a convex portion 92, generally approximating a quartersphere in shape, and a concave recess portion 94, also generally approximating a quartersphere in shape, which is located adjacent to, and in reflected orientation with the convex portion 92 At the plane of intersection or reflection between the concave and convex portions, there is formed a flat shoulder or face 96. The two finger holds 88 are positioned 180 degrees apart in reference to the central axis 84 on the biasing wheel upper surface 86. The finger holds 88 are further oriented so that the faces 96 are disposed in opposite directions to enable the user to apply a force couple to said faces using the thumb and index finger causing the biasing member 80 to rotate in a clockwise direction, and thereby apply a biasing force to the frame members.

Integrally formed on the periphery of the cam element 90 are four camming faces 98 (shown in the perspective view of FIG. 12 and in the cross sectional view of FIG. 14), having a spiral ramp configuration or profile disposed so as to apply a radially outward camming force against a cam-opposing surface when the biasing member 80 is rotated clockwise. A circumferential slot 100 is formed centrally between axially adjacent camming surfaces 98, with a slot depth configured to preserve the nominal diameter of the cam portion 90 in the space formed by the slot 100 between adjacent camming surfaces 98.

The biasing means of this forth embodiment additionally includes a rigid, preferrably plastic disk 102 with a thickness slightly less than the lateral width of the circumferential slot 100 of the biasing means. This rigid disk 102 has a centrally located clearance aperture 104 shaped to provide complementary clearance when the cam element 90 of the biasing member 80 is inserted therethrough.

Figure 15:
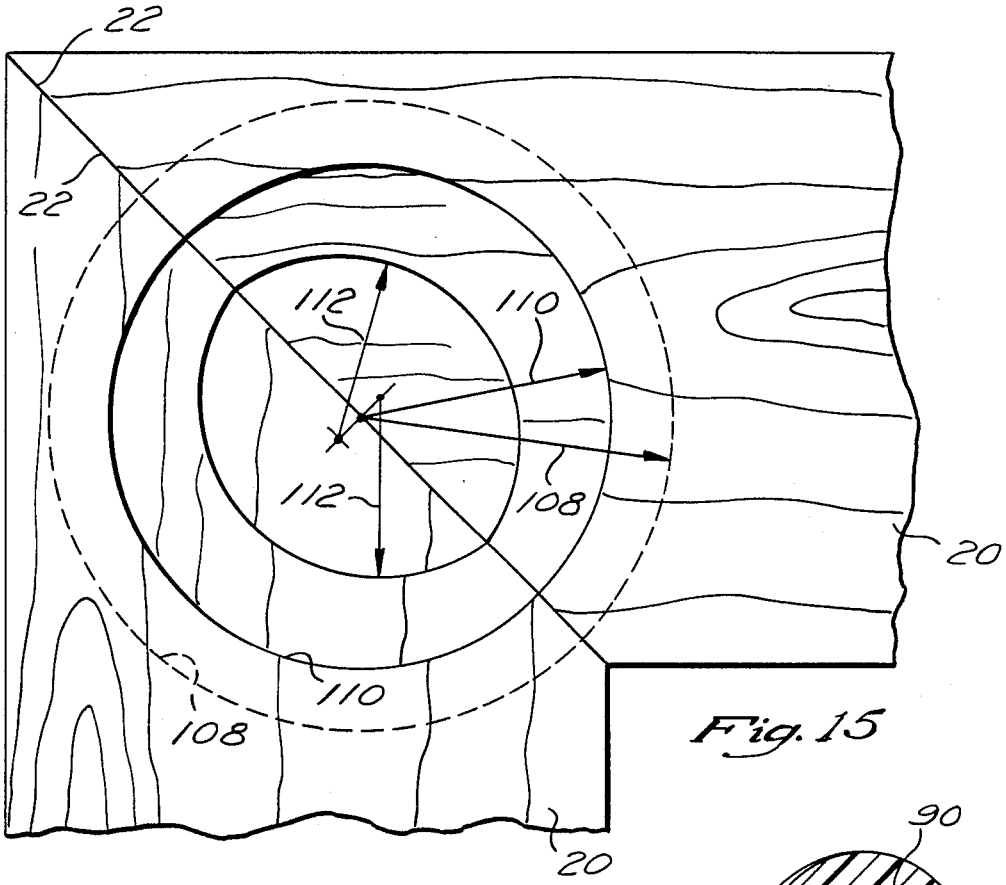
FIG. 15 shows a corner of the fourth embodiment frame of the present invention with the central bore, middle cavity and counterbore.
Figure 14:
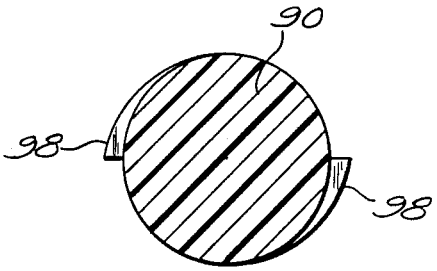
FIG. 14 is a cross-sectional view taken along lines 14—14 of FIG. 12 showing the cam portion and camming surfaces used in the biasing member according to the fourth of the present invention.
Figure 16:
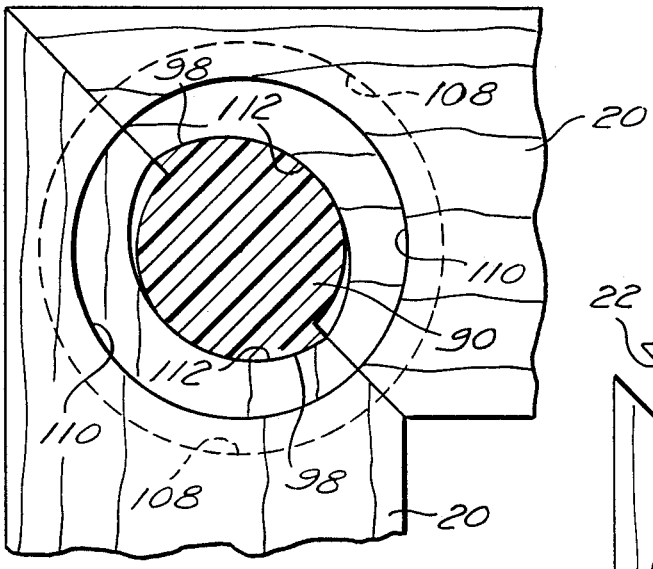
FIG. 16 shows a corner of the fourth embodiment frame of the present invention, further showing the position of the cam portion and camming faces of the biasing means as inserted in the central bore prior to the biasing means rotated.

As shown in FIGS. 13, 15 and 16, each of the frame members 20 in the fourth embodiment has and defines within its mitered ends a central cavity or central bore 106, coaxial with a larger diameter middle cavity 108, and an intermediate diameter counterbore section 110. The middle cavity 108 is formed in a semicircular configuration in the shape of a half disk, sized to tightly receive one half of the rigid disk 102. The counter bore section 110 also has a semicircular configuration in the shape of a half disk with a diameter and depth equal to the diameter and thickness, respectively, of the biasing wheel 82. these three features of two adjacent such frame members 20 abut in complementary aligned registry. When abutted together these features thereby form cavities into which the biasing member 80 and the rigid disk 102 are received.

To assemble the biasing means of the fourth embodiment, the rigid disk 102 is first inserted into the complementary middle cavity 108 of a frame member 20. The mitered end 22 of another frame member 20 is then placed in complementary abutment with the mitered end of the first frame member. With the middle cavity 108 of the second frame member receiving the remaining portion or half of the rigid disk 102 thereinto. The biasing member 80 is then inserted into the frame assembly with the cam element 90 being received through the clearance aperture 104 of the rigid disk 102 and into the central bore section 106 and the biasing wheel portion 82 being received by the counter bore section 112. The depths of the central bore section 106 and the counter bore section 110 are sized such that when the biasing member 80 is inserted, the upper side 86 of the biasing wheel is coplanar with the back side or surfaces of the two abutting frame members 20. As shown in FIGS. 15 and 16, the lateral sides or circumferential periphery of the central bore 106 are shaped to provide a complementary and contiguous fit with the camming surfaces 98 of the cam portion 90 when the biasing member is in the unrotated position shown in FIG. 16. These lateral sides therefore become cam-opposing surfaces 112 in the biasing means of this embodiment. When assembled, the biasing means appears as shown from the back side of the picture frame in FIG. 10.

Figure 17:
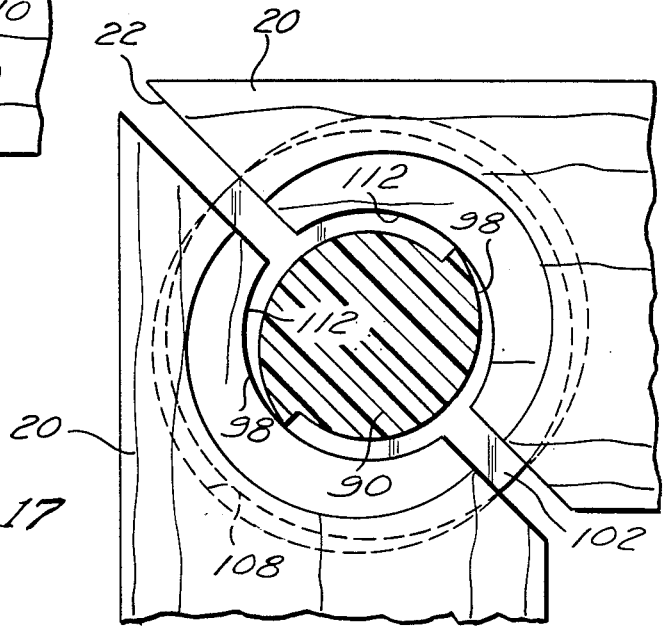
FIG. 17 the same view as FIG. 16 with the cam portion of the biasing means rotated and the frame members cammed to their expanded position.

With the biasing means so assembled, the canvas is stretched taught on the frame members 20 by grasping the finger holds 88 and turning the biasing wheel 82 clockwise, thereby rotating the cam portion 90 within the central bore 106. As illustrated in FIG. 17, when so rotated, the camming surfaces 98 of the cam portion 90 cam against the cam-opposing surfaces 112 on the lateral side of the central bore, causing the frame members 20 expand away from the initial abutted configuration in FIG. 10 to the expanded configuration shown in FIG. 11.

It will be noted that because the rigid disk 102 is tightly received within the middle recess 108, it serves to prevent twisting of the frame components relative to one another. It should be further noted that with the biasing means in place in the frame assembly, the middle cavity 108 and rigid disk 102 are at the same depth location in the central bore 106 as the circumferential slot 100 of the biasing means. The circumferential slot 100 thus acts as a clearance feature to prevent the camming faces 98 from engaging the complementary receiving features 114 on the rigid disk 102 when the biasing means is rotated and thereby prevents the rigid disk 102 from also rotating with the biasing means. This feature additionally serves to lock in the biasing means once it is rotated to tension the canvas. Once the biasing member 80 is rotated relative to the rigid disk 102, the complementary receiving features 114 of the central aperture are no longer in angular alignment with the lateral sides of the camming surfaces 98 and therefore abut against said sides, preventing the biasing means from being accidentally pulled back through the aperture.

In accordance with the preceeding discussion, the present invention should be perceived to broadly encompass diverse considerations and solutions to the constant tensioning of stretched canvas upon and by a persistently expansive frame. Correspondingly, the present invention should be interpreted in accordance with the following claims only, and not solely, in accordance with those embodiments within which the present invention has been taught.

What is claimed is:

1. An expansive frame apparatus comprising:

a plurality of frame members each having end portions disposed in an abutted orientation to an adjacent member to frame an area;

a central bore formed at said end portion of each frame member, which central bore aligns with a corresponding central bore in the corresponding end portion of an adjacent frame member;

a middle cavity formed coaxial with said central bore at said end portion of each frame member, which middle cavity aligns with a corresponding middle cavity in the corresponding end portion of an adjacent frame member;

a counter bore formed coaxial with said central bore and middle cavity at said end portion of each frame member, which counter bore aligns with a corresponding counter bore in the corresponding end portion of an adjacent frame member;

biasing means, fitting between adjacent frame members and extending into said central bore and counter bore thereon, whereby said biasing means, when rotated, is adapted to exert a camming force on said frame members, thereby forcing the frame members apart from abutting contact;

wherein each of said plurality frame members end portions are mitered to abut corresponding end portions of an adjacent frame member in a complementary fashion, wherein said biasing means comprises a biasing member having a cam portion and a biasing wheel portion rigidly affixed to said cam portion;

a plurality of camming surfaces affixed to said cam portion and adapted to exert said camming force on said frame members when said biasing means is rotated;

a cam-opposing surface formed on said central bore, said cam opposing surface shaped to provide a camming interface between said central bore and said camming surfaces on said cam portion for forcing the frame members apart from abutting contact;

finger hold means disposed on said biasing wheel of said biasing means for applying a force couple to said biasing wheel to rotate said biasing means;

a rigid disk complementary to and receivable in said middle cavities in said end portions of said frame members, wherein said rigid disk and said middle cavity are cooperatively configured so that said rigid disk fits tightly within said middle cavities, thereby insuring that adjacent frame members will not twist relative to one another; and a clearance aperture centrally located on said rigid disk, shaped to receive through complementary features of said clearance aperture said cam portion and said camming surfaces of said biasing means, and thereby allow said cam portion to be received into said central bore.

2. The frame apparatus of claim 1 further comprising a circumferential slot formed on said cam portion, positioned to allow said cam portion to be rotated without engaging and also rotating said rigid disk.

3. The frame apparatus of claim 2 wherein said circumferential slot is positioned laterally between said camming surfaces causing the lateral sides of said complementary features of said clearance aperture on said rigid disk to abut against the lateral sides of said camming surfaces after said biasing means is rotated, and thereby preventing said biasing means from being accidentally pulled back out from engagement with said frame members.

4. An expansive frame apparatus comprising:

a plurality of frame members each having end portions disposed in an abutted orientation to an adjacent frame member to frame in area;

a central bore formed at said end portion of each frame member, which central bore aligns with the corresponding central bore in the corresponding end portion of an adjacent frame member;

a middle cavity formed coaxial with said central bore at said end portion of each frame member, which middle cavity aligns with the corresponding middle cavity in the corresponding end portion of an adjacent frame member;

a counter bore formed coaxial with said central bore and middle cavity at said end portion of each frame member, which counter bore aligns with the corresponding counter bore in the corresponding end portion of an adjacent frame member;

a rigid disk formed complementary to and receivable in said middle cavities in said end portions of adjacent frame members; and camming means configured to be received between adjacent frame members and extend into said central bore and counter bore thereon, whereby said camming means when rotated is adapted to exert a camming force on said adjacent frame members thereby forcing the frame members apart from abutting contact, said camming means sized to extend through an aperture formed in said rigid disks and configured to allow rotational movement of said camming means within said aperture without rotating said rigid disk.

5. The frame apparatus of claim 4 wherein said rigid disk is sized to be tightly received within said middle cavities of adjacent frame members thereby insuring that adjacent frame members will not twist relative one another.

6. The frame apparatus of claim 5 further comprising means formed on said camming means engageable with said rigid disk to prevent said camming means from being accidentally pulled out of engagement with said frame members.

* * * * *